US006971737B2

(12) United States Patent
Sugahara

(10) Patent No.: US 6,971,737 B2
(45) Date of Patent: Dec. 6, 2005

(54) PRESSURE GENERATING MECHANISM, MANUFACTURING METHOD THEREOF, AND LIQUID DROPLET EJECTION DEVICE INCLUDING PRESSURE GENERATING MECHANISM

(75) Inventor: Hiroto Sugahara, Aichi-Ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 106 days.

(21) Appl. No.: 10/657,255

(22) Filed: Sep. 9, 2003

(65) Prior Publication Data

US 2004/0051761 A1 Mar. 18, 2004

(30) Foreign Application Priority Data

Sep. 17, 2002 (JP) ..... 2002-269862

(51) Int. Cl.[7] ..... B41J 2/045
(52) U.S. Cl. ..... 347/68; 347/40; 347/72
(58) Field of Search ..... 310/328, 330, 310/331, 332, 334; 347/40, 65, 66, 68–73

(56) References Cited

U.S. PATENT DOCUMENTS 5,729,264 A * 3/1998 Pankert et al. ..... 347/71
6,328,432 B1 * 12/2001 Oota ..... 347/68
6,354,685 B1 * 3/2002 Ohashi ..... 347/11
6,409,320 B1 * 6/2002 Kurihara et al. ..... 347/68
6,560,871 B1 * 5/2003 Ramos et al. ..... 29/890.1
2002/0024567 A1 2/2002 Takagi
2002/0051041 A1 5/2002 Takagi

FOREIGN PATENT DOCUMENTS

JP 06-115070 * 4/1994 ..... B41J 3/04
JP A 7-33087 4/1995
JP A 2002-59547 2/2002
JP A 2002-127420 5/2002

* cited by examiner

*Primary Examiner*—Manish S. Shah
*Assistant Examiner*—Geoffrey S. Mruk
(74) *Attorney, Agent, or Firm*—Oliff & Berridge, PLC

(57) ABSTRACT

An actuator unit includes piezoelectric ceramic sheets put in layers. Common and individual electrodes are disposed alternately between the piezoelectric ceramic sheets. Each portion of a piezoelectric ceramic sheet where common and individual electrodes overlap each other is a deformable active portion. Each active portion corresponds to a pressure chamber of an ink passage unit. When a drive electric field is applied selectively between common and individual electrodes in a pair, the corresponding active portion is deformed along the thickness direction of the piezoelectric ceramic sheet to change the volume of the corresponding pressure chamber. Microcrack regions provided on both sides of the deformed active portion prevent the deformation of the active portion from propagating to neighboring active portions.

16 Claims, 13 Drawing Sheets

RELATED ART

PRESSURE GENERATING MECHANISM, MANUFACTURING METHOD THEREOF, AND LIQUID DROPLET EJECTION DEVICE INCLUDING PRESSURE GENERATING MECHANISM

BACKGROUND OF THE INVENTION

1. Field of the Invention

The present invention relates to a pressure generating mechanism, for example, used for applying pressure to ink in an ink-chamber in an inkjet printer. The present invention relates also to a manufacturing method of the pressure generating mechanism, and a liquid droplet ejection device including the pressure generating mechanism.

2. Description of Related Art

U.S. patent application publication No. 2002/0024567 and U.S. Pat. No. 6,536,880 disclose a pressure generating mechanism of piezoelectric type used for applying pressure to ink in an ink chamber in an inkjet printer. FIG. 13 illustrates a sectional view of an inkjet head including therein an actuator unit as a piezoelectric type pressure generating mechanism.

In the inkjet head 101 of FIG. 13, an actuator unit 106 and a passage unit 107 are put in layers. The actuator and passage units 106 and 107 are bonded to each other with an epoxy-base thermosetting adhesive. Ink passages are formed in the passage unit 107. The actuator unit 106 is driven with a drive pulse signal, which can take selectively one of the ground potential and a predetermined positive potential, generated in a non-illustrated drive circuit. For applying the drive pulse signal from the non-illustrated drive circuit to the actuator unit 106, a flexible printed wiring board is bonded to the upper face of the actuator unit 106 though the flexible printed wiring board is not illustrated in FIG. 13.

The passage unit 107 is made up of three metal plates, i.e., a cavity plate 107*a*, a spacer plate 107*b*, and a manifold plate 107*c*, and a nozzle plate 107*d* made of a synthetic resin such as polyimide, which are put in layers. Nozzles 109 for ejecting ink are formed in the nozzle plate 107*d*. The cavity plate 107*a* in the uppermost layer is in contact with the actuator unit 106.

Pressure chambers 110 are formed in the cavity plate 107*a* for receiving therein ink to be selectively ejected by an action of the actuator unit 106. The pressure chambers 110 are arranged in two rows along the length of the inkjet head 101, i.e., in a right-left direction of FIG. 13. Partitions 110*a* separate the pressure chambers 110 from each other. Longitudinal axes of the pressure chambers 110 are parallel to one another.

In the spacer plate 107*b* formed are connection holes 111 for connecting one ends of the pressure chambers 110 to the respective nozzles 109, and non-illustrated connection holes for connecting the other ends of the pressure chambers 110 to manifold channels.

In the manifold plate 107*c* formed are connection holes 113 for connecting one ends of the pressure chambers 110 to the respective nozzles 109. In the manifold plate 107*c* further formed are manifold channels for supplying ink to the pressure chambers 110. The manifold channels are formed under the respective rows of the pressure chambers 110 to extend along the rows. One end of each manifold channel is connected to a non-illustrated ink supply source.

Thus, ink passages are formed each extending from a manifold channel through a non-illustrated connection hole, a pressure chamber 110, a connection hole ill, and a connection hole 113 to a nozzle 109.

In the actuator unit 106, six piezoelectric ceramic plates 106*a* to 106*f*, each made of a ceramic material of lead zirconate titanate (PZT), are put in layers. Common electrodes 121 and 123 are provided between the piezoelectric ceramic plates 106*b* and 106*c* and between the piezoelectric ceramic plates 106*d* and 106*e*, respectively. Each of the common electrodes 121 and 123 is formed only in an area above the corresponding pressure chamber 110 of the passage unit 107.

Individual electrodes 122 and 124 are provided between the piezoelectric ceramic plates 106*c* and 106*d* and between the piezoelectric ceramic plates 106*e* and 106*f*, respectively. Each of the individual electrodes 122 and 124 is formed only in an area above the corresponding pressure chamber 10 of the passage unit 107.

The common electrodes 121 and 123 are always kept at the ground potential. On the other hand, a drive pulse signal is applied to individual electrodes 122 and 124 in a pair. Portions of the piezoelectric ceramic plates 106*c* to 106*e* sandwiched by the common electrodes 121 and 123 and the individual electrodes 122 and 124 are active portions 125 having been polarized along the thickness of each piezoelectric ceramic plate by an electric field applied in advance through the electrodes. Therefore, when individual electrodes 122 and 124 in a pair are set at a predetermined positive potential, the corresponding active portions 125 of the piezoelectric ceramic plates 106*c* to 106*e* are going to extend in the thickness of each piezoelectric ceramic plate because of the applied electric field. However, this phenomenon does not appear in the piezoelectric ceramic plates 106*a* and 106*b*. As a result, the portion of the actuator unit 106 corresponding to the active portions 125 swells up into the corresponding pressure chamber 110. Because the volume of the pressure chamber 110 is thus decreased, ejection pressure is applied to the ink filling the pressure chamber 110 and thereby ink is ejected through the corresponding nozzle 109.

Using the left pressure chamber 110, FIG. 13 illustrates a state wherein the volume of the pressure chamber 110 is decreased by the actuator unit 106 swelled into the pressure chamber 110 because a predetermined positive potential is applied to the corresponding pair of individual electrodes 122 and 124, and thereby ink is going to be ejected through the nozzle 109 connected to the pressure chamber 110. As for the right pressure chamber 110, FIG. 13 illustrates a state wherein ink is not ejected through the nozzle 109 connected to the pressure chamber 110 because the corresponding pair of individual electrodes 122 and 124 are kept at the ground potential like the common electrodes 121 and 123.

In the inkjet head 101 of FIG. 13, when a predetermined positive potential is applied to a pair of individual electrodes 122 and 124 for ejecting ink through the corresponding nozzle 109, crosstalk may occur wherein the mechanical deformation of the corresponding active portions 125 affects neighboring active portions 125. More specifically, as illustrated in FIG. 13, as a reaction to the downward deformation of one unit of active portions 125, the neighboring unit of active portions 125 is deformed upward. Simultaneously with this, both sides of the partition 110*a* facing the respective pressure chambers 110 are inclined toward the pressure chamber 110 for which the electric potential has been applied. As a result, the partition 110 is deformed into a parallelogram in section. Thus, the pressure in the neighboring pressure chamber 110 has also been changed though any electric potential has not been applied for the pressure chamber 110. This may bring about changes in speed and volume of an ink droplet ejected through the nozzle 109 corresponding to the pressure chamber 110 in the next ejection action. This causes an error of ink impact position and unevenness in print density, and therefore lowers the print quality.

For this reason, U.S. Pat. No. 5,128,694 discloses a technique for reducing crosstalk by forming slits, each extending along the thickness of the piezoelectric ceramic plates, in the intervals between active portions in the actuator unit with a diamond cutter. In this technique, however, the process itself for forming the slits each extending along the thickness of the piezoelectric ceramic plates, with a diamond cutter, is very troublesome. Further, because a washing process is necessary after the slit formation process, it requires a long-time work. There is a problem that no good manufacture efficiency can be obtained.

SUMMARY OF THE INVENTION

An object of the present invention is to provide a pressure generating mechanism in which crosstalk has been reduced and which can be easily manufactured in a short time, a manufacturing method of the pressure generating mechanism, and a liquid droplet ejection device including the pressure generating mechanism.

According to an aspect of the present invention, a pressure generating mechanism comprises a plate member made of a piezoelectric material; first electrodes disposed at the plate member at intervals in a plane direction of the plate member; and second electrodes opposite to the first electrodes in a thickness direction of the plate member substantially perpendicular to the plane direction of the plate member. The plate member comprises active portions formed in the plate member at intervals in the plane direction of the plate member. Each of the active portions are sandwiched by the corresponding first and second electrodes and deformable in the thickness direction of the plate member. The plate member further comprises a microcrack region formed in the plate member between neighboring active portions. The microcrack region includes therein a large number of microcracks.

According to the invention, because the microcrack region is formed in the plate member between the neighboring active portions, crosstalk between the neighboring active portions can be reduced. In addition, because microcracks can be formed without using a diamond cutter unlike the case of forming slits extending along the thickness of the plate member, they can be easily formed in a short time. Further, because crosstalk can be reduced, the number of layers in the plate member can be increased relatively to the prior art. Therefore, even if deformation of one layer is little, large deformation can be obtained as a whole. Thus, the first or second electrode can be driven by a low voltage. This may bring about a decrease in cost of a circuit component for generating a drive signal for the first or second electrode.

BRIEF DESCRIPTION OF THE DRAWINGS other and further objects, features and advantages of the invention will appear more fully from the following description taken in connection with the accompanying drawings in which.

DESCRIPTION OF THE PREFERRED EMBODIMENTS

Figure 1:
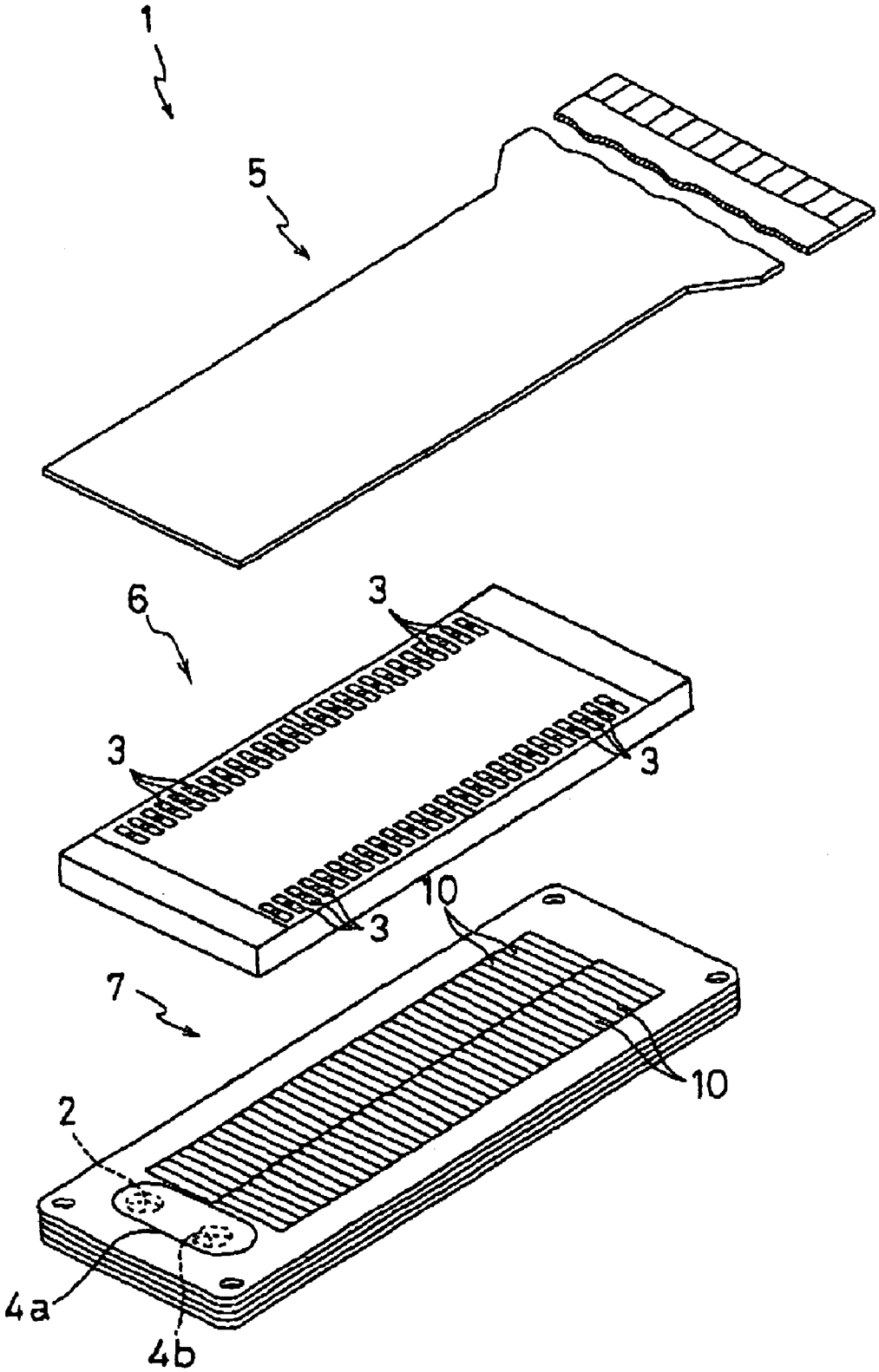
FIG. 1 is an exploded perspective view of an inkjet head including an actuator unit as a pressure generating mechanism according to a first embodiment of the present invention.

First will be described an inkjet head including an actuator unit as a pressure generating mechanism according to a first embodiment of the present invention. As illustrated in FIG. 1, a piezoelectric inkjet head 1 of this embodiment includes a substantially rectangular parallelepiped passage unit 7 and an actuator unit 6 having substantially the same shape as the passage unit 7. The actuator unit 6 is put on the passage unit 7. A flexible flat cable or a flexible printed circuit (FPC) 5 is attached to the upper face of the actuator unit 6 for connecting the actuator unit 6 to an external circuit. The inkjet head 1 ejects ink downward through nozzles 9 (see FIGS. 2 and 3) each open in the lower face of the passage unit 7.

A large number of surface electrodes 3 are provided on the upper face of the actuator unit 6 for electrically connecting the actuator unit 6 to the FPC 5. A large number of pressure chambers (liquid chambers) 10 each open upward are formed in an upper portion of the passage unit 7. A pair of supply holes 4*a* and 4*b* is formed in one end portion of the passage unit 7 in the length of the passage unit 7. As will be described later, each of the supply holes 4*a* and 4*b* is connected to a manifold channel 15 (see FIG. 3). The supply holes 4*a* and 4*b* are covered with a filter 2 for removing dust from ink supplied from a non-illustrated ink cartridge.

Figure 2:
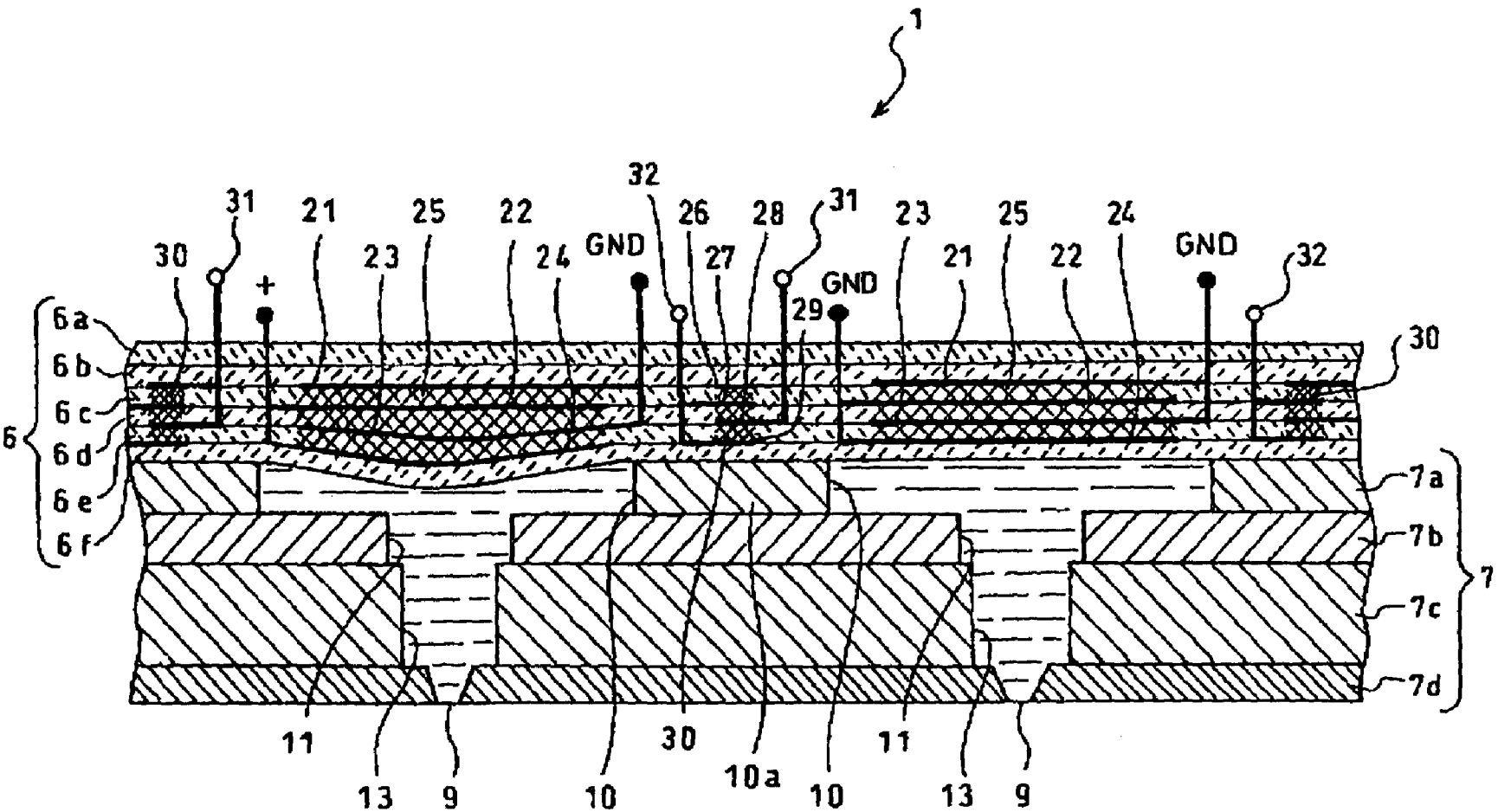
FIG. 2 is a partial sectional view of the inkjet head of FIG. 1 taken along the length of the inkjet head.
Figure 3:
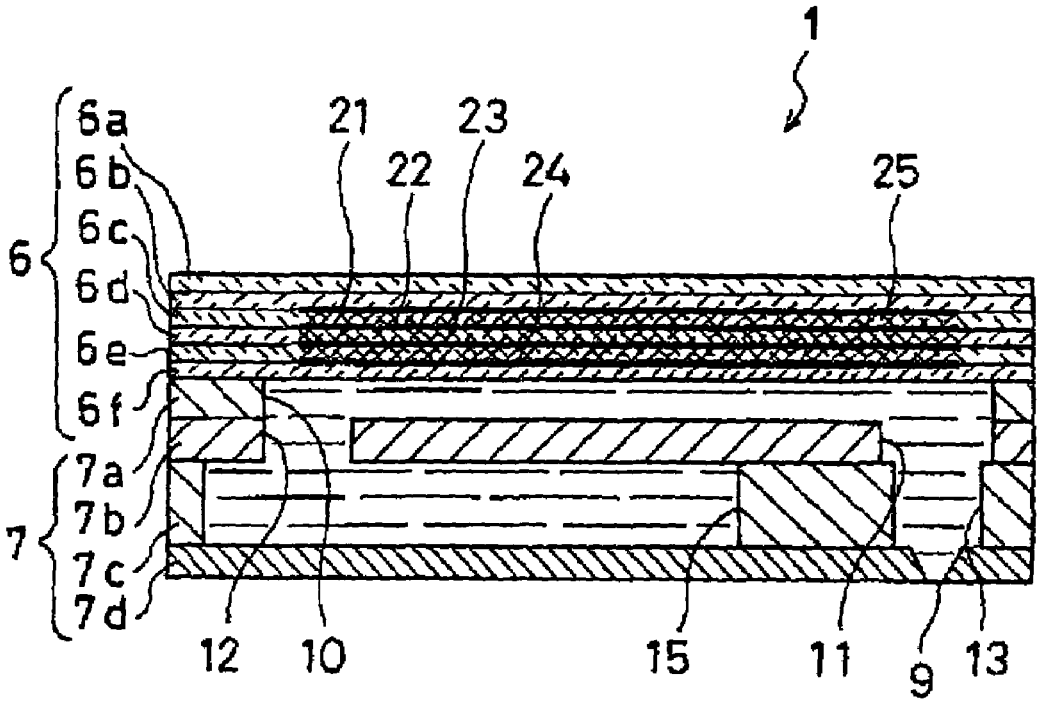
FIG. 3 is a partial sectional view of the inkjet head of FIG. 1 taken along the width of the inkjet head.

Next, a specific structure of the inkjet head 1 will be described with reference to FIGS. 2 and 3. FIG. 2 is a partial sectional view of the inkjet head of FIG. 1 taken along the length of the inkjet head. FIG. 3 is a partial sectional view of the inkjet head of FIG. 1 taken along the width of the inkjet head. In FIGS. 2 and 3 omitted is illustration of the FPC 5 on the actuator unit 6.

As illustrated in FIGS. 2 and 3, the actuator unit 6 and the passage unit 7 are put in layers. The actuator and passage units 6 and 7 are bonded to each other with an epoxy-base thermosetting adhesive. Ink passages are formed in the passage unit 7. The actuator unit 6 is driven through the FPC 5 with a drive pulse signal, which can take selectively one of the ground potential and a predetermined positive potential, generated in a non-illustrated drive circuit.

The passage unit 7 is made up of three metal plates, i.e., a cavity plate 7*a*, a spacer plate 7*b*, and a manifold plate 7*c*, and a nozzle plate 7*d* made of a synthetic resin such as polyimide, which are put in layers. Nozzles 9 for ejecting ink are formed in the nozzle plate 7*d*. The cavity plate 7*a* in the uppermost layer is in contact with the actuator unit 6.

Pressure chambers 10 are formed in the cavity plate 7*a* for receiving therein ink to be selectively ejected by an action of the actuator unit 6. The pressure chambers 10 are arranged in two rows along the length of the inkjet head 1, i.e., in a right-left direction of FIG. 2. Partitions 10*a* separate the pressure chambers 10 from each other. Longitudinal axes of the pressure chambers 10 are parallel to one another.

In the spacer plate 7*b* formed are connection holes 11 for connecting one ends of the pressure chambers 10 to the respective nozzles 9, and connection holes 12 (see FIG. 3) for connecting the other ends of the pressure chambers 10 to manifold channels 15 as will be described later.

In the manifold plate 7*c* formed are connection holes 13 for connecting one ends of the pressure chambers 10 to the respective nozzles 9. In the manifold plate 7*c* further formed are manifold channels 15 for supplying ink to the pressure chambers 10. The manifold channels 15 are formed under the respective rows of the pressure chambers 10 to extend along the rows. One end of each manifold channel 15 is connected to a non-illustrated ink supply source through the corresponding one of the supply holes 4*a* and 4*b* of FIG. 1.

Thus, ink passages are formed each extending from a manifold channel 15 through a connection hole 12, a pressure chamber 10, a connection hole 11, and a connection hole 13 to a nozzle 9.

In the actuator unit 6, six piezoelectric ceramic plates 6*a* to 6*f*, each made of a ceramic material of lead zirconate titanate (PZT), are put in layers. Common electrodes 21 and 23 as second electrodes are provided between the piezoelectric ceramic plates 6*b* and 6*c* and between the piezoelectric ceramic plates 6*d* and 6*e*, respectively. Each of the common electrodes 21 and 23 is formed only in an area above the corresponding pressure chamber 10 of the passage unit 7 (see FIG. 3). In a modification, large-sized common electrodes 21 and 23 may be used to cover substantially the whole area of each piezoelectric ceramic plate.

Individual electrodes 22 and 24 as first electrodes are provided between the piezoelectric ceramic plates 6*c* and 6*d* and between the piezoelectric ceramic plates 6*e* and 6*f*, respectively. Each of the individual electrodes 22 and 24 is formed only in an area above the corresponding pressure chamber 10 of the passage unit 7 (see FIG. 3).

As illustrated in FIG. 2, the common electrodes 21 and 23 are always kept at the ground potential. On the other hand, a drive pulse signal is applied to individual electrodes 22 and 24 in a pair. Portions of the piezoelectric ceramic plates 6*c* to 6*e* sandwiched by the common electrodes 21 and 23 and the individual electrodes 22 and 24 are active portions 25 having been polarized along the thickness of each piezoelectric ceramic plate by an electric field applied in advance through the electrodes. In the plan view, each active portion 25 extends along the corresponding pressure chamber 10 and has a rectangular shape included in the corresponding pressure chamber 10 (see FIG. 5).

When individual electrodes 22 and 24 in a pair are set at a predetermined positive potential, the corresponding active portions 25 of the piezoelectric ceramic plates 6*c* to 6*e* are going to extend in the thickness of each piezoelectric ceramic plate because of the applied electric field. However, this phenomenon does not appear in the piezoelectric ceramic plates 6*a* and 6*b*. As a result, the portion of the actuator unit 6 corresponding to the active portions 25 swells up into the corresponding pressure chamber 10. Because the volume of the pressure chamber 10 is thus decreased, ejection pressure is applied to the ink filling the pressure chamber 10 and thereby ink is ejected through the corresponding nozzle 9.

Using the left pressure chamber 10, FIG. 2 illustrates a state wherein the volume of the pressure chamber 10 is decreased by the actuator unit 6 swelled into the pressure chamber 10 because a predetermined positive potential is applied to the corresponding pair of individual electrodes 22 and 24, and thereby ink is going to be ejected through the nozzle 9 connected to the pressure chamber 10. As for the right pressure chamber 10, FIG. 2 illustrates a state wherein ink is not ejected through the nozzle 9 connected to the pressure chamber 10 because the corresponding pair of individual electrodes 22 and 24 is kept at the ground potential like the common electrodes 21 and 23.

To eject ink, a method "fill before fire" may be adopted. In the method "fill before fire", a voltage is always applied to all individual electrodes 22 and 24 to decrease the volumes of all pressure chambers 10 like the left pressure chamber of FIG. 2. Only the individual electrodes 22 and 24 of a pressure chamber to be used for ink ejection are relieved from the voltage. The volume of the pressure chamber is thereby increased like the right pressure chamber of FIG. 2 to generate a negative pressure wave. Afterward, the voltage is again applied to the individual electrodes 22 and 24 to decrease the volume of the pressure chamber 10. Thereby, synchronously with the timing when the negative pressure wave is reversed to positive, a positive pressure wave generated by the application of the voltages is superimposed on the negative pressure wave. Thus, using the pressure wave propagating in the pressure chamber 10, ejection pressure is efficiently applied to ink.

Figure 4:
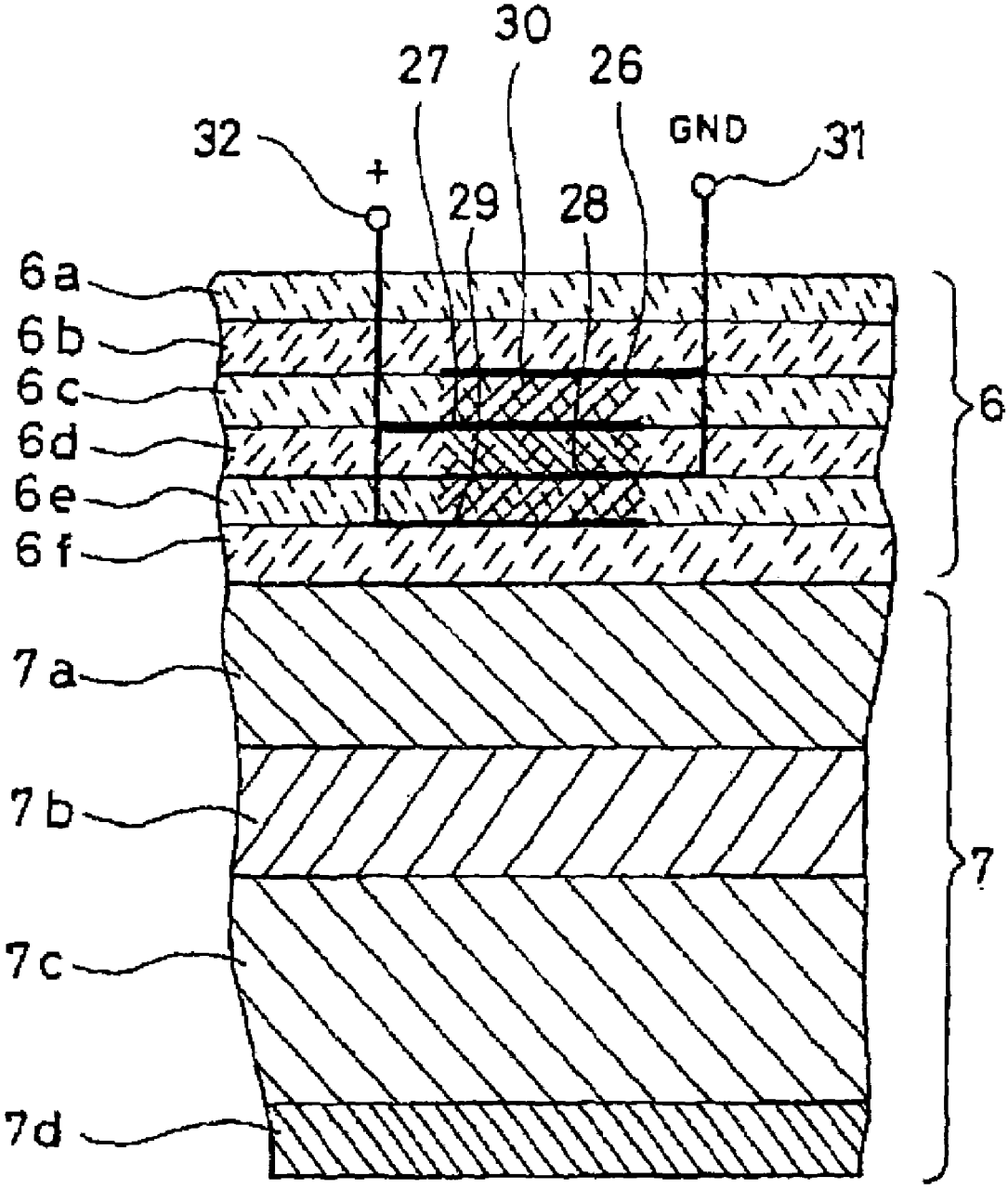
FIG. 4 is an enlarged view of a portion of the inkjet head of FIG. 2 between neighboring active portions.
Figure 5:
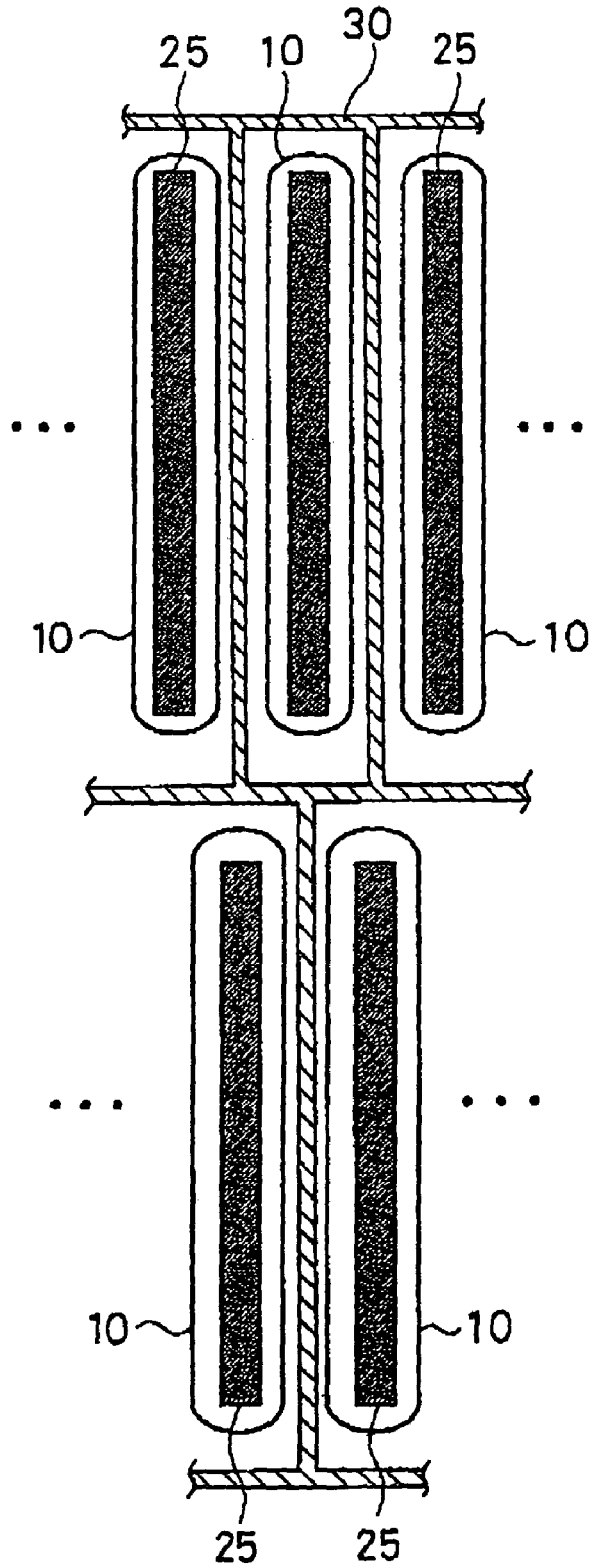
FIG. 5 illustrates a positional relation in the plan view among pressure chambers, active portions, and microcrack regions that are continuously formed with each other.

As described above, in this embodiment, the actuator unit 6 includes therein the active portions 25 each deformable substantially perpendicularly to a plane direction of the piezoelectric ceramic plates 6*a* to 6*f*, i.e., in a thickness direction of the piezoelectric ceramic plates 6*a* to 6*f*. In addition, between neighboring active portions 25 in the plane direction of the actuator unit 6, microcrack regions 30 are provided where a large number of microcracks are formed. This will be described with reference to FIGS. 4 and 5. FIG. 4 is an enlarged view of a portion of the inkjet head of FIG. 2 between neighboring active portions 25. FIG. 5 illustrates a positional relation in the plan view among pressure chambers 10, active portions 25, and microcrack regions 30 that are continuously formed with each other.

As illustrated in FIGS. 2 and 4, in the thickness of the piezoelectric ceramic plates 6*a* to 6*f*, microcrack regions 30 are provided in only three piezoelectric ceramic plates 6*c* to 6*e* of the six piezoelectric ceramic plates 6*a* to 6*f*. As illustrated in FIG. 5, the microcrack regions 30 are arranged, in the plane direction of the piezoelectric ceramic plates 6*a* to 6*f*, in two rows like the arrangement of the pressure chambers 10 and formed into a lattice. The microcrack regions 30 completely isolate neighboring active portions 25 from each other.

In the three piezoelectric ceramic plates 6*c* to 6*e*, the microcrack regions 30 are formed only in regions where first microcrack formation electrodes 26 and 28 as third electrodes and second microcrack formation electrodes 27 and 29 as fourth electrodes, as will be described below, overlap each other. This is because microcracks are formed by applying relatively intense electric fields between the first microcrack formation electrodes 26 and 28 and the second microcrack formation electrodes 27 and 29 to locally damage the piezoelectric ceramic plates 6*c* to 6*e*. The actuator unit 6 is fixed to the partitions 10*a* of the passage unit 7 below the microcrack regions 30 (see FIG. 2).

In each interval between neighboring active portions 25, the first microcrack formation electrodes 26 and 28 are provided between the piezoelectric ceramic plates 6*b* and 6*c* and between the piezoelectric ceramic plates 6*d* and 6*e*, respectively. In each interval between neighboring active portions 25, the second microcrack formation electrodes 27 and 29 are provided between the piezoelectric ceramic plates 6*c* and 6*d* and between the piezoelectric ceramic plates 6*e* and 6*f*, respectively. Each of the first and second microcrack formation electrodes 26 to 29 has a plurality of electrode segments that are unitarily formed into a lattice in the plan view, similarly to the microcrack region 30.

The first microcrack formation electrodes 26 and 28 are connected to a common terminal 31. The second microcrack formation electrodes 27 and 29 are connected to a common terminal 32. The terminals 31 and 32 are connected to terminals of the FPC 5, respectively. As will be described later, in the manufacturing process of the inkjet head 1, the terminal 31 is kept at the ground potential and a relatively high positive potential is temporally applied to the terminal 32.

As described above, in the actuator unit 6 as a pressure generating mechanism according to this embodiment, microcrack regions 30 are provided in the piezoelectric ceramic plates 6*c* to 6*e* between neighboring active portions 25. Therefore, upon ink ejection, propagation of deformation of active portions 25 to the neighboring active portions 25 is partially interrupted and thereby crosstalk between the neighboring active portions 25 can be reduced. Thus, printing in high quality is possible.

Particularly in this embodiment, as illustrated in FIG. 5, because the microcrack regions 30 completely isolate neighboring active portions 25 from each other in plane, a remarkable effect of reducing crosstalk can be expected. However, in case that neighboring active portions 25 are thus completely isolated by the microcrack regions 30 as in FIG. 5, common wiring cannot be used for the common electrodes 21 and 23 of the neighboring active portions 25. There is a problem that the wiring structure is complicated.

Figure 6:
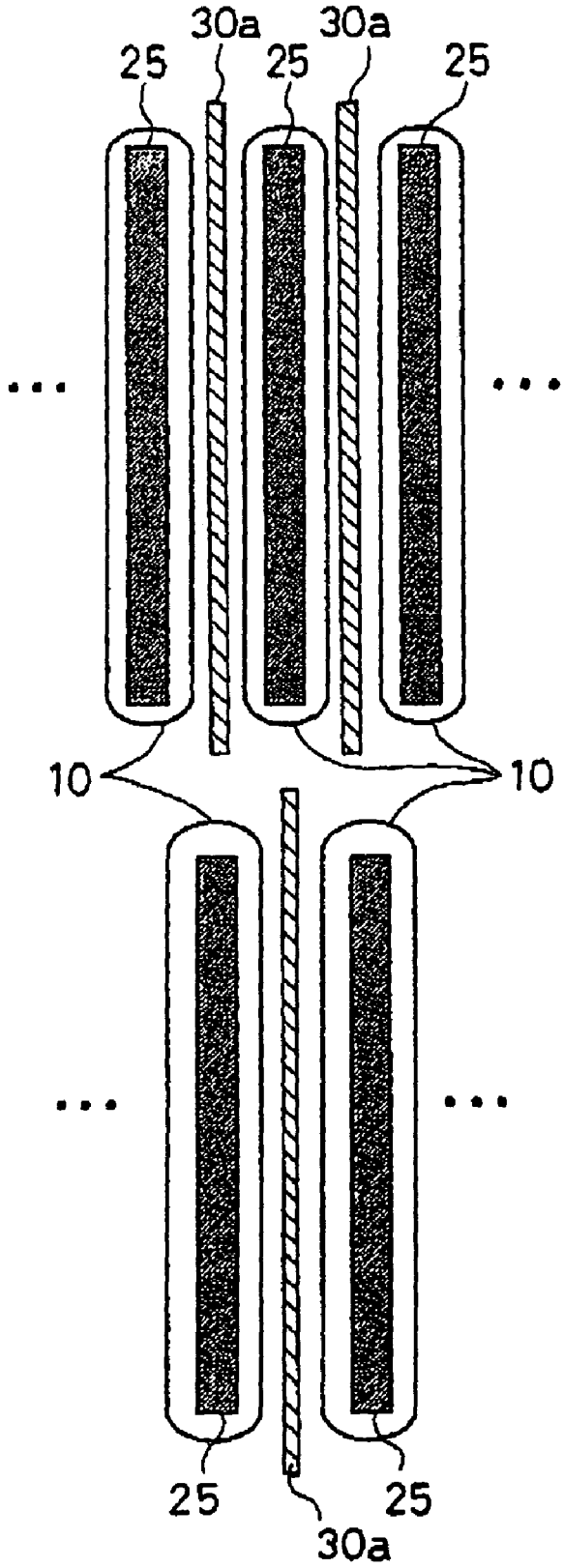
FIG. 6 illustrates a modification of FIG. 5.

For this reason, in a modification, the continuously formed microcrack regions 30 may be divided somewhere between neighboring active portions 25. Thus, the common electrodes 21 and 23 of the neighboring active portions 25 can be connected to each other through gaps of the microcrack regions 30. This can simplify the wiring structure though the effect of reducing crosstalk is somewhat deteriorated. In another modification, as illustrated in FIG. 6, separate microcrack portions 30*a* each having a rectangular shape may be provided between active portions 25 neighboring each other along the length of the actuator unit 6. In this case, the first and second microcrack formation electrodes 26 to 29 are separate electrodes provided corresponding to the separate microcrack region 30*a*. Also in the case of microcrack regions 30*a* of FIG. 6, good effect of reducing crosstalk can be obtained though it is lower than that of FIG. 5.

As apparent from the manufacturing method as will be described later, microcrack regions 30 can be formed without using a diamond cutter unlike the case of forming slits extending along the thickness of the piezoelectric ceramic plates 6*c* to 6*e*. They can be easily formed in a short time.

In the actuator unit 6 of this embodiment, because crosstalk can be reduced, the number of piezoelectric ceramic plates to be put in layers can be increased relatively to the prior art. Therefore, even if deformation of one piezoelectric ceramic plate is little, large deformation can be obtained as a whole. Thus, the individual electrodes 22 and 24 can be driven by a low voltage. This may bring about a decrease in cost of a circuit component for generating a drive pulse signal for the individual electrodes 22 and 24.

In the actuator unit 6 of this embodiment, as apparent from the manufacturing method as will be described later, by setting the first microcrack formation electrodes 26 and 28 and the second microcrack formation electrodes 27 and 29 at different potentials, an electric field can be applied between those electrodes. Therefore, microcracks can be very easily formed in the piezoelectric ceramic plates 6*c* to 6*e*.

In the actuator unit 6 of this embodiment, the common electrodes 21 and 23 and the individual electrodes 22 and 24 are provided alternately between the piezoelectric ceramic plates 6*b* to 6*f* in the thickness direction of the piezoelectric ceramic plates 6*b* to 6*f*. In addition, the first microcrack formation electrodes 26 and 28 and the second microcrack formation electrodes 27 and 29 are provided alternately between the piezoelectric ceramic plates 6*b* to 6*f* in the thickness direction of the piezoelectric ceramic plates 6*b* to 6*f*. Thus, the piezoelectric ceramic plates 6*c* to 6*e* are sandwiched by the first microcrack formation electrodes 26 and 28 and the second microcrack formation electrodes 27 and 29. Therefore, as apparent from the manufacturing method as will be described later, because the distance between electrodes is short, a very high potential need not be applied to the second microcrack formation electrodes 27 and 29 for forming microcracks. Further, because microcrack regions 30 can be formed in the three piezoelectric ceramic plates 6*c* to 6*e*, crosstalk between active portions 25 can be effectively reduced in comparison with the case wherein microcracks are formed in only one piezoelectric ceramic plate.

In the inkjet head 1 of this embodiment, the actuator unit 6 is fixed to the partitions 10*a* of the passage unit 7 below the microcrack regions 30. Therefore, deformation of each active portion 25 can be effectively used as a change in volume of the corresponding pressure chamber 10. This brings about an advantage that good energy efficiency can be obtained.

Next, a manufacturing method of the inkjet head 1 including the actuator unit of this embodiment will be described with reference to the flowchart of FIG. 7. To manufacture such an inkjet head 1 as described with reference to FIGS. 1 to 5, parts such as a passage unit 7 and an actuator unit 6 are separately fabricated and then the parts are assembled.

To fabricate a passage unit 7, four plates 7*a* to 7*d* as illustrated in FIG. 2 are made independently of each other. The four plates 7*a* to 7*d* are then put in layers while being positioned to each other. In this state, they are bonded to each other with an adhesive. Pressure chambers 10, connection holes 11, and so on, are formed in the plates 7*a* to 7*c* by etching. Nozzles 9 are formed in the plate 7*d* with a laser beam. These processes are performed in Step S1.

To fabricate an actuator unit 6, first, two piezoelectric ceramic green sheets on each of which conductive paste has been deposited into individual electrodes 22 or 24 and second microcrack formation electrodes 27 or 29 by screen printing, and two piezoelectric ceramic green sheets on each of which conductive paste has been deposited into common electrodes 21 or 23 and first microcrack formation electrodes 26 or 28 by screen printing, are alternately put in layers. Further, one piezoelectric ceramic green sheet on which no pattern has been printed, and one piezoelectric ceramic green sheet on which conductive paste has been deposited into surface electrodes 3 by screen printing, are in order put on the above layered structure. These processes are performed in Step S2. Thus, an electrode complex to be an actuator unit 6 is obtained.

The electrode complex obtained in Step S2 is degreased like known ceramics and then sintered at a predetermined temperature (Step S3). Thus, an actuator unit 6 as described above can be relatively easily fabricated. The actuator unit 6 is designed by considering in advance shrinkage upon sintering.

Afterward, the passage unit 7 and the actuator unit 6 are bonded to each other with a thermosetting adhesive in a state wherein portions to be active portions 25 of the actuator unit 6 are positioned to the respective pressure chambers 10 of the passage unit 7. Further, the actuator unit 6 and an FPC 5 prepared separately are bonded to each other by soldering so that each surface electrode 3 is put on the corresponding electrode on the FPC 5. These processes are performed in Step S4. In a modification, bonding the FPC 5 to the actuator unit 6 may be performed after Step S5 as will be described later. In this case, an electric field is applied to the microcrack formation electrodes 26 to 29 by a means different from the FPC 5.

Afterward, in a state wherein the first microcrack formation electrodes 26 and 28 are kept at the ground potential, a high potential is applied to the second microcrack formation electrodes 27 and 29 through the FPC 5. Thereby, an intense electric field exceeding the breakdown limit of the piezoelectric ceramic plates 6*c* to 6*e*, for example, more than about 6.4 to 24 kV/mm, which is 8 to 30 times the electric field to be applied upon ink ejection operation, is applied to portions of the piezoelectric ceramic plates 6*c* to 6*e* sandwiched by the first microcrack formation electrodes 26 and 28 and the second microcrack formation electrodes 27 and 29. Thus, because of local breakdown, each of the portions of the piezoelectric ceramic plates 6*c* to 6*e* is made into a microcrack region 30 where a large number of microcracks have been formed (Step S5).

Afterward, in a state wherein the common electrodes 21 and 23 are kept at the ground potential, a high potential lower than the potential applied to the second microcrack formation electrodes 27 and 29 in Step S5, is applied to the individual electrodes 22 and 24 through the FPC 5. Thereby, an intense electric field not exceeding the breakdown limit of the piezoelectric ceramic plates 6*c* to 6*e*, for example, about 1.6 to 6.4 kV/mm, which is 2 to 8 times the electric field to be applied upon ink ejection operation, is applied to portions of the piezoelectric ceramic plates 6*c* to 6*e* sandwiched by the common electrodes 21 and 23 and the individual electrodes 22 and 24. Thus, each portion of the piezoelectric ceramic plates 6*c* to 6*e* is polarized to be an active portion 25 deformable substantially perpendicularly to the plane direction of the piezoelectric ceramic plates 6*c* to 6*e* upon ink ejection operation (Step S6). An inkjet head 1 is completed through the above-described processes.

The above-described manufacturing method has an advantage that microcracks can be formed in a very short time by applying an intense electric field to the portions of the piezoelectric ceramic plates 6*c* to 6*e* between the first microcrack formation electrodes 26 and 28 and the second microcrack formation electrodes 27 and 29. In addition, the method has an advantage that the microcracks can be formed with high positional accuracy. Further, because no washing process is necessary after the microcracks are formed, an actuator unit 6 in which crosstalk is reduced can be easily fabricated in a short time in comparison with the case wherein slits are formed between active portions 25 by mechanical processing as described before.

In the above-described manufacturing method, the active portions 25 and the microcrack regions 30 are formed after the actuator unit 6 and the passage unit 7 are bonded to each other. In a modification, however, the active portions 25 and the microcrack regions 30 are formed before the actuator unit 6 and the passage unit 7 are bonded to each other. Further, if the order of the microcrack formation step of Step S5 and the active portion formation step of Step S6 is inverted, it brings about no problem.

Figure 8:
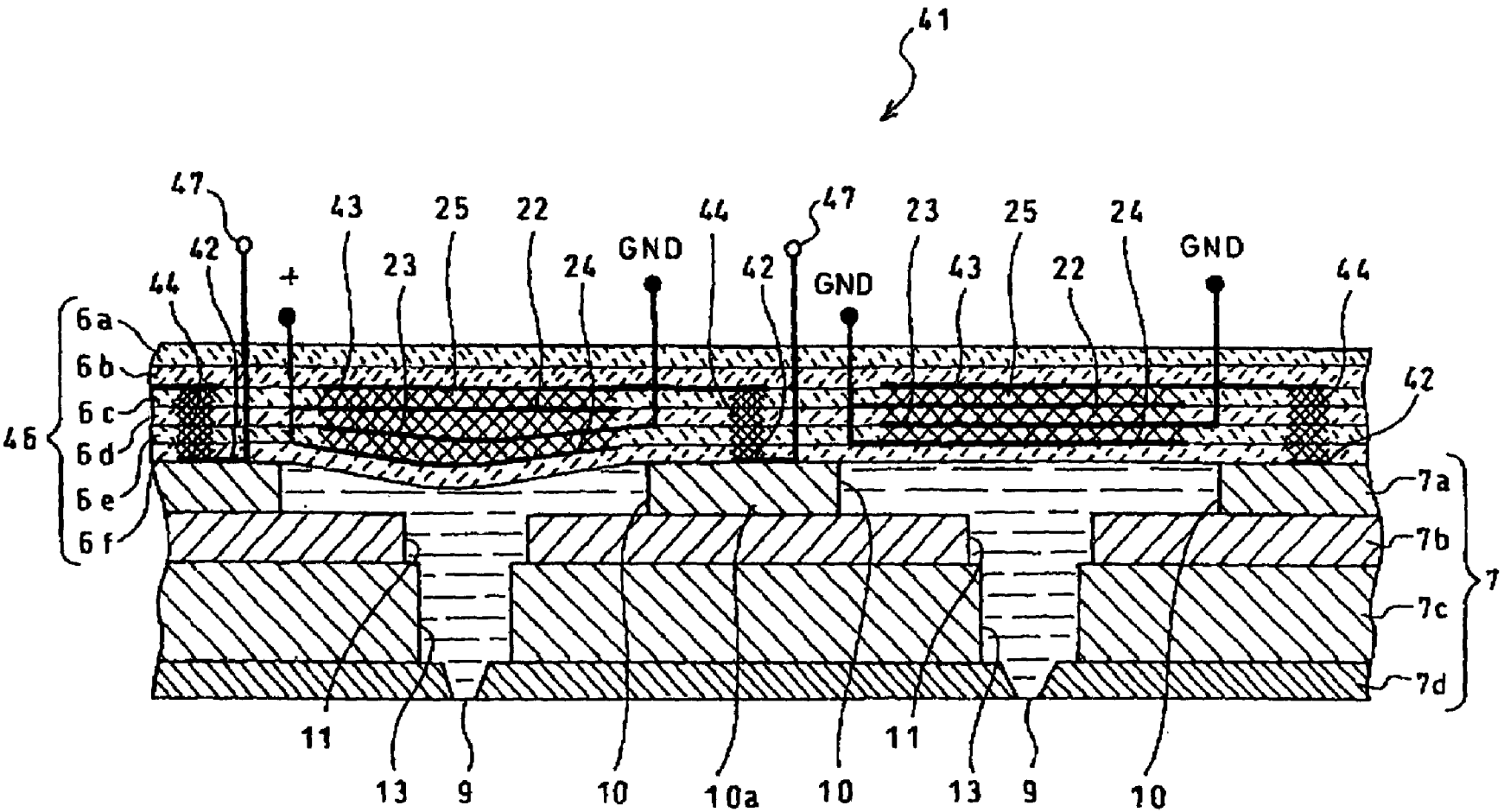
FIG. 8 is a partial sectional view of an inkjet head including an actuator unit as a pressure generating mechanism according to a second embodiment of the present invention, taken along the length of the inkjet head.

Next, an inkjet head including an actuator unit as a pressure generating mechanism according to a second embodiment of the present invention will be described with reference to FIG. 8. FIG. 8 is a partial sectional view of an inkjet head taken along the length of the inkjet head, like FIG. 2. In this embodiment, the same components as in the first embodiment are denoted by the same reference numerals as in the first embodiment, respectively, and thereby description of those components is omitted.

In the inkjet head 41 of FIG. 8, a common electrode 43, kept at the ground potential, on a piezoelectric ceramic plate 6*c* included in an actuator unit 46 is elongated in one direction to about the midpoint between active portions 25 neighboring in the plane direction of the actuator unit 46. Between two active portions 25 neighboring each other, one first microcrack formation electrode 42 as a third electrode is only provided on the lower face of a piezoelectric ceramic plate 6*f*. There is no second microcrack formation electrode to form a pair with the first microcrack formation electrode 42, unlike the above-described first embodiment. Only regions of four piezoelectric ceramic plates 6*c* to 6*f* sandwiched by the right extension of the common electrode 43 in FIG. 8 and the first microcrack formation electrode 42 are made into microcrack regions 44. The first microcrack formation electrode 42 is connected to a terminal 47. The inkjet head 41 has the same structure as the inkjet head 1 of the first embodiment except the above-described difference.

Figure 7:
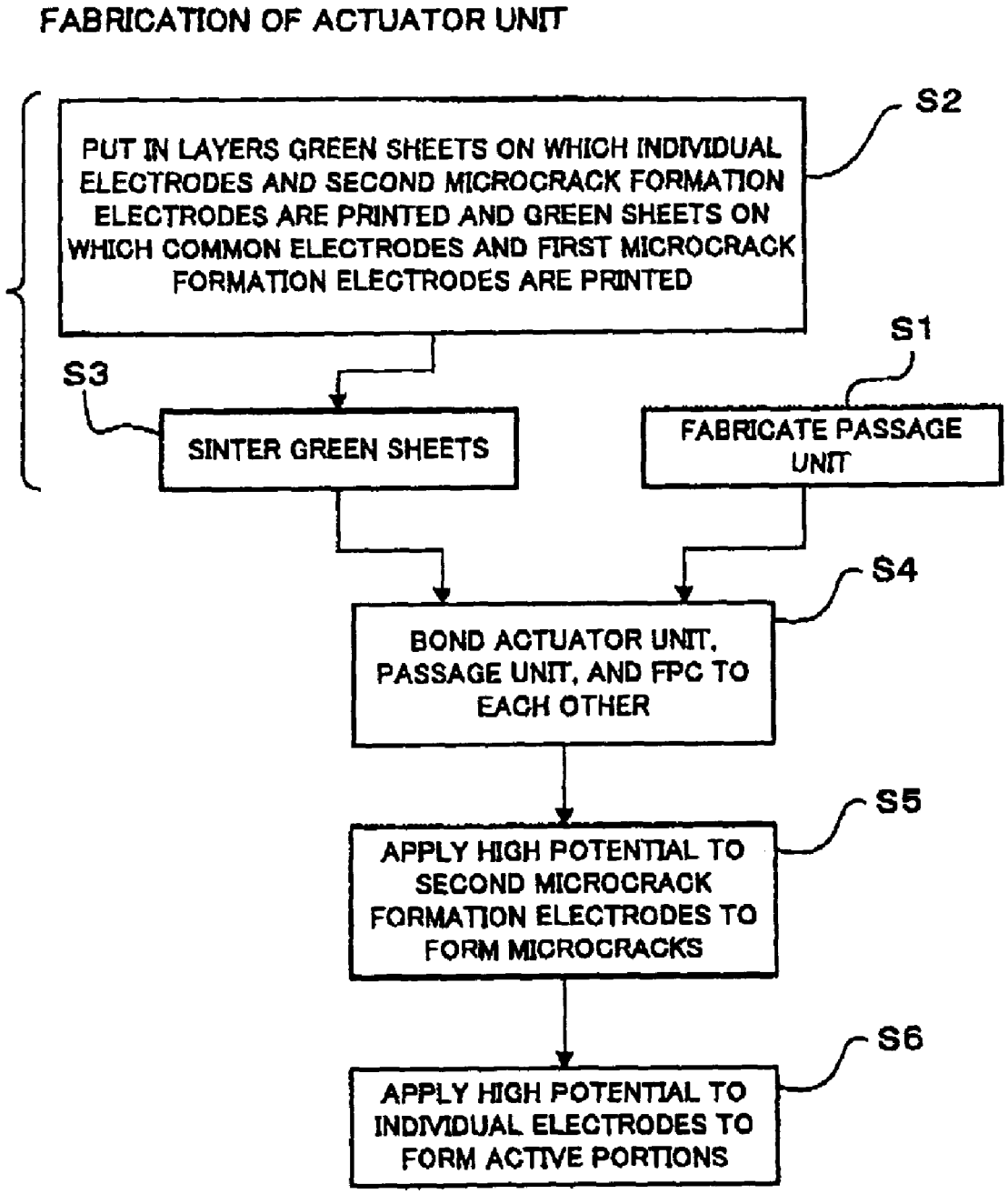
FIG. 7 is a flowchart of a manufacturing process of the inkjet head of FIG. 1.

The manufacturing process of the inkjet head 41 of FIG. 8 is generally the same as that of FIG. 7. In this embodiment, however, a high potential is applied to the first microcrack formation electrode 42 through the terminal 47 in Step S5. Thus, an intense electric field is applied between the first microcrack formation electrode 42 and the common electrode 43 and thereby the portions of the piezoelectric ceramic plates 6*c* to 6*f* sandwiched by the electrodes are made into microcrack regions 44.

In the actuator unit 46 as a pressure generating mechanism of this embodiment, microcrack regions 44 are formed in four piezoelectric ceramic plates 6*c* to 6*f* between neighboring active portions 25. Therefore, upon ink ejection, propagation of deformation of active portions 25 to the neighboring active portions 25 is partially interrupted and thereby crosstalk between the neighboring active portions 25 can be reduced, like the first embodiment. Thus, printing in high quality is possible. In addition, the other effects of the first embodiment can be obtained also in this second embodiment.

In the actuator unit 46 of this embodiment, however, no microcrack formation electrodes are provided between the piezoelectric ceramic plates 6*c* to 6*f* where the microcrack regions 44 are to be formed. Only on the uppermost and lowermost sides of the four piezoelectric ceramic plates 6*c* to 6*f*, the electrodes 42 and 43 are provided to sandwich the piezoelectric ceramic plates 6*c* to 6*f*. Therefore, because the distance between the electrodes is large, a potential about several times higher than the potential applied to the second microcrack formation electrodes 27 and 29 in the first embodiment must be applied to the first microcrack formation electrode 42.

In this embodiment, no second microcrack formation electrode need be provided to form a pair with the first microcrack formation electrode 42. Thus, the wiring structure in the actuator unit 46 is simplified. This makes the manufacture of the actuator unit 46 easy.

In this embodiment, only one first microcrack formation electrode 42 is provided and only one of two common electrodes 23 and 43 is elongated to about the midpoint between the neighboring active portions 25 to correspond to the first microcrack formation electrode 42. Therefore, the first microcrack formation electrode 42 and the common electrode 43 sandwich four piezoelectric ceramic plates 6*c* to 6*f*. Thus, because microcrack regions 44 are formed in the piezoelectric ceramic plates larger in number than those in the first embodiment, a superior effect of reducing crosstalk can be obtained.

In addition, the structure is simplified in comparison with the case wherein two first microcrack formation electrodes are provided and two common electrodes are elongated to about the midpoint between the neighboring active portions 25. This affords a simple structure and an improved yield.

In this embodiment, a common electrode 43 is elongated to about the midpoint between the neighboring active portions 25. In a modification of this embodiment, however, in place of the common electrode 43, an individual electrode may be elongated to about the midpoint between the neighboring active portions 25. In this case, to form microcrack regions 44, a high potential is applied to the elongated individual electrode and the first microcrack formation electrode 42 is kept at the ground potential.

Figure 9:
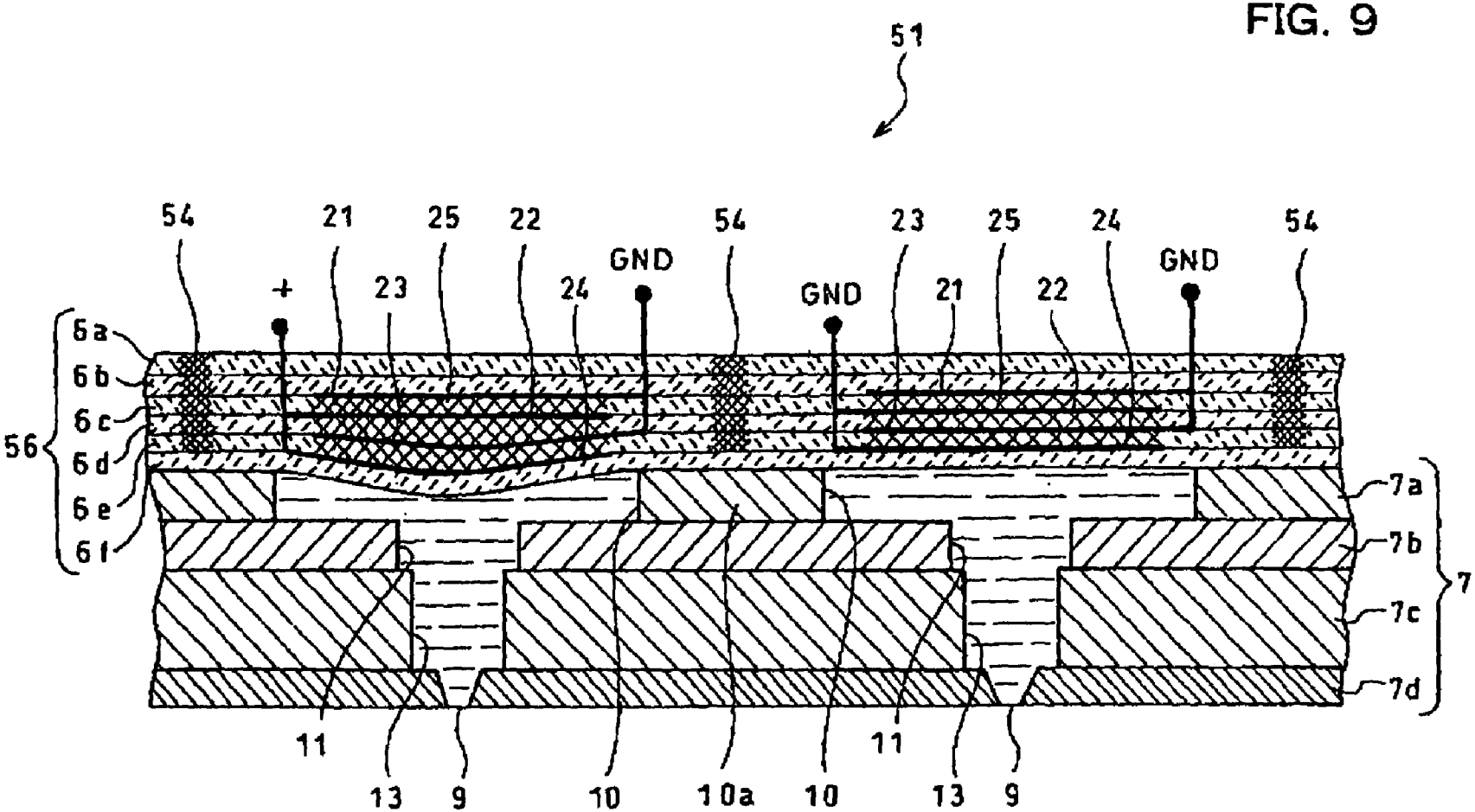
FIG. 9 is a partial sectional view of an inkjet head including an actuator unit as a pressure generating mechanism according to a third embodiment of the present invention, taken along the length of the inkjet head.

Next, an inkjet head including an actuator unit as a pressure generating mechanism according to a third embodiment of the present invention will be described with reference to FIG. 9. FIG. 9 is a partial sectional view of an inkjet head taken along the length of the inkjet head, like FIG. 2. In this embodiment, the same components as in the first embodiment are denoted by the same reference numerals as in the first embodiment, respectively, and thereby description of those components is omitted.

In the inkjet head 51 of FIG. 9, no microcrack formation electrodes are provided between neighboring active portions in an actuator unit 56, unlike the above-described first and second embodiments. In spite of this, microcrack regions 54 are formed in five piezoelectric ceramic plates 6*a* to 6*e* between active portions 25 neighboring each other in the plane direction of the actuator unit 56. This means that the microcrack regions 54 are formed through a process different from those of the above-described first and second embodiments. The inkjet head 51 has the same structure as the inkjet head 1 of the first embodiment except the above-described difference.

In the actuator unit 56 as a pressure generating mechanism of this embodiment, microcrack regions 54 are formed in five piezoelectric ceramic plates 6*a* to 6*e* between neighboring active portions 25. Therefore, upon ink ejection, propagation of deformation of active portions 25 to the neighboring active portions 25 is partially interrupted and thereby crosstalk between the neighboring active portions 25 can be reduced, like the first and second embodiments. Thus, printing in high quality is possible. In addition, the other effects of the first embodiment can be obtained also in this third embodiment.

Next, a manufacturing method of the inkjet head 51 of FIG. 9 will be described mainly in point of the difference from the first embodiment.

Figure 10:
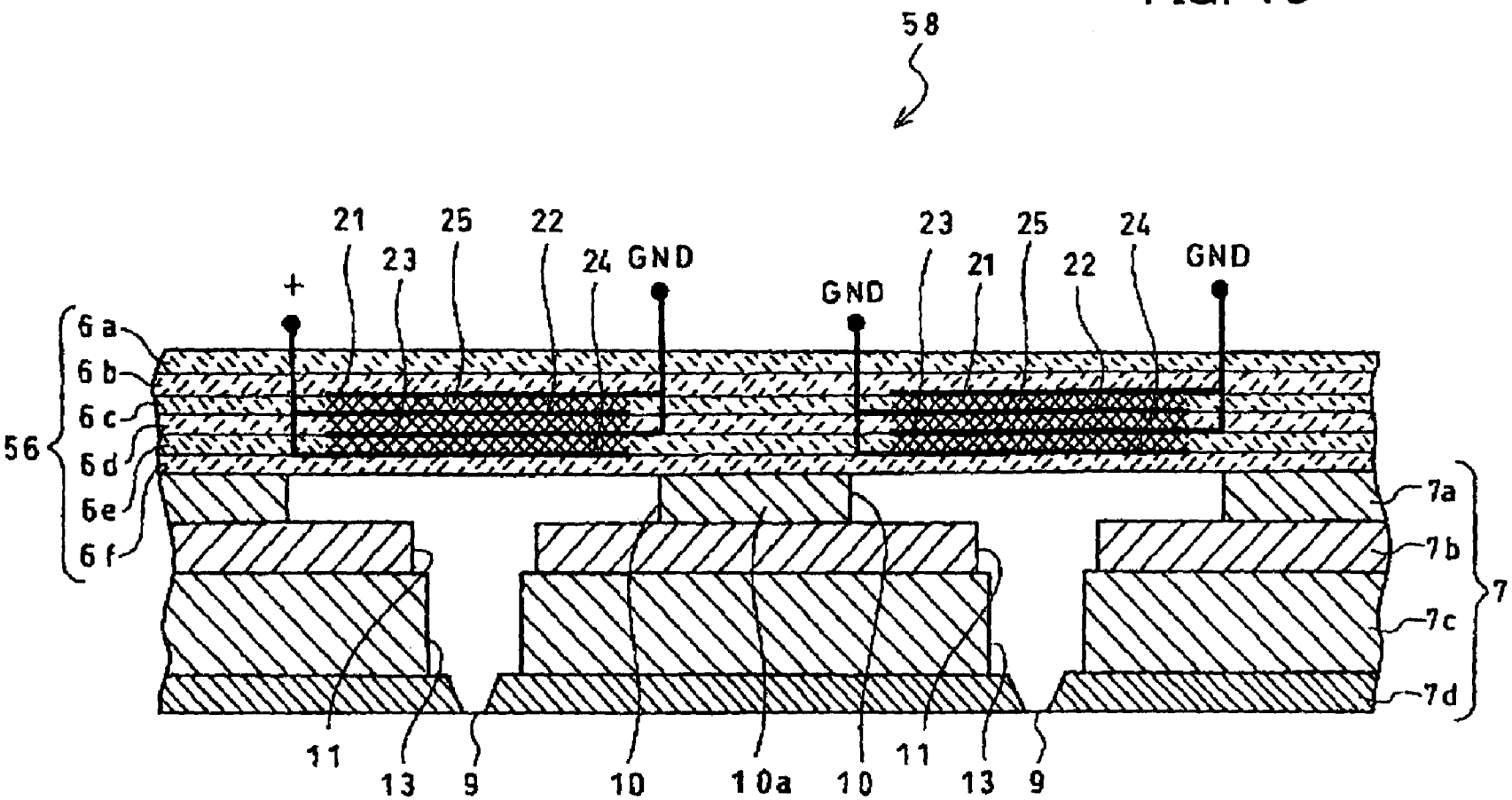
FIG. 10 is a sectional view of the inkjet head of FIG. 9 in a manufacturing step.

First, in Step S2 of FIG. 7, without printing conductive paste on green sheets to form first and second microcrack formation electrodes, conductive paste is printed on green sheets to form common electrodes 21 and 23 and individual electrodes 22 and 24, Afterward, in Step S4, an actuator unit 56 obtained through the green sheet sintering process of Step S3 and a passage unit 7 obtained in Step S1 are bonded to each other. Thus, a structure 58 of FIG. 10 to be an inkjet head 51 is obtained, which is the same as the inkjet head 51 of FIG. 9 except that microcrack regions 54 and active portions 25 have not yet been formed.

Figure 11:
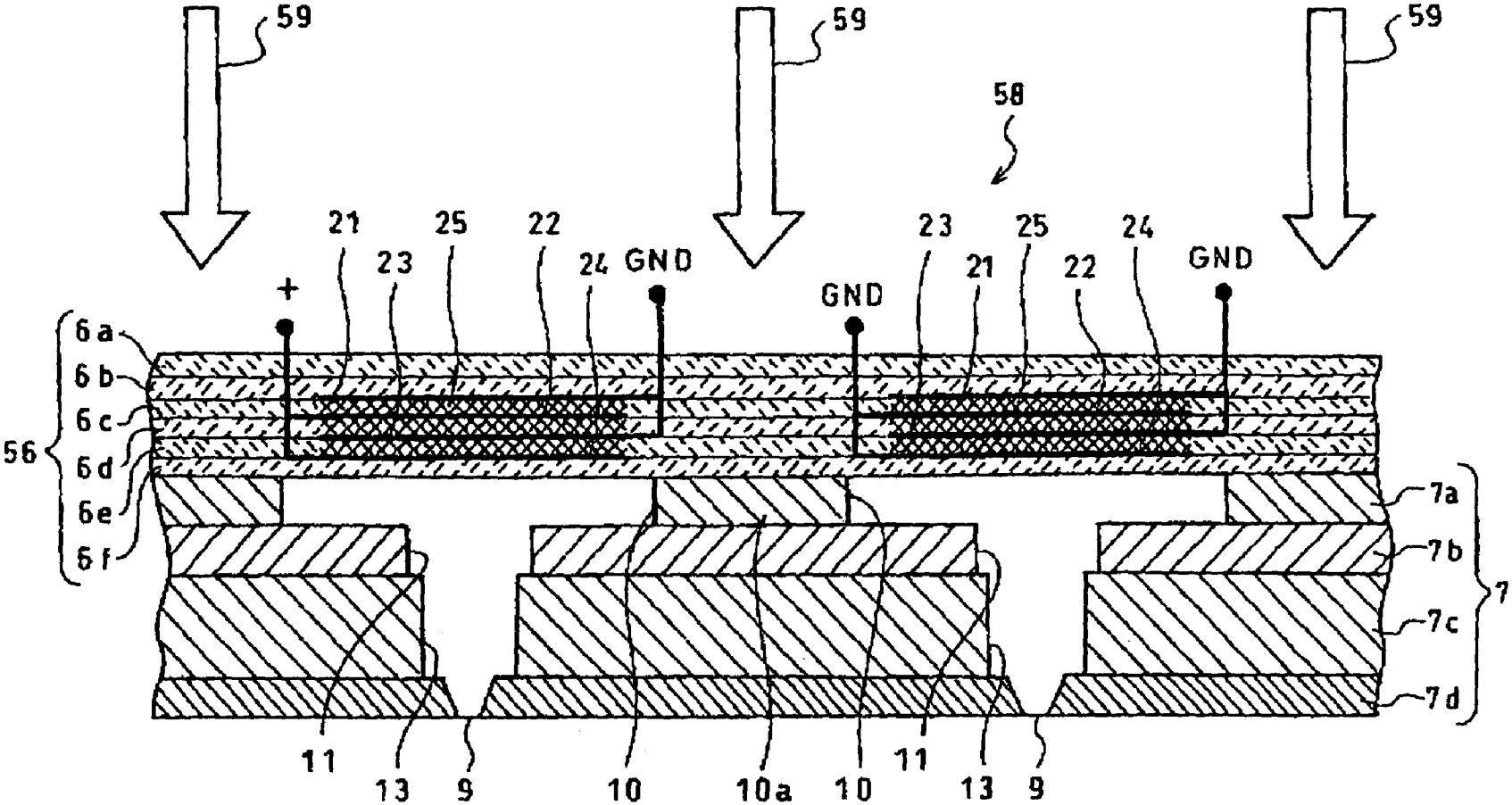
FIG. 11 is a sectional view of the inkjet head of FIG. 9 in a manufacturing step after the step of FIG. 10.
Figure 12:
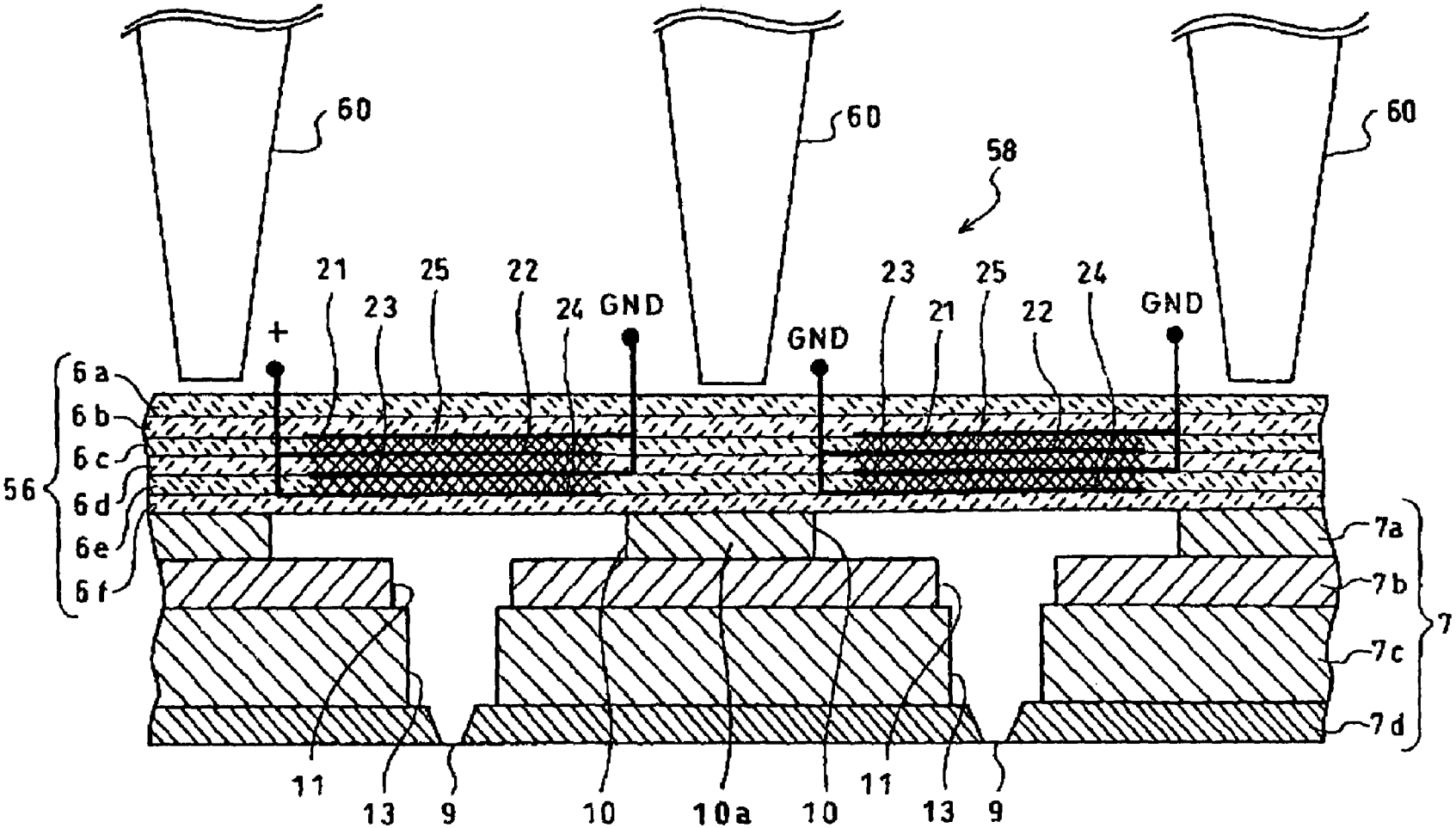
FIG. 12 is a sectional view of the inkjet head of FIG. 9 in a manufacturing step, as a modification of FIG. 11.
Figure 13:
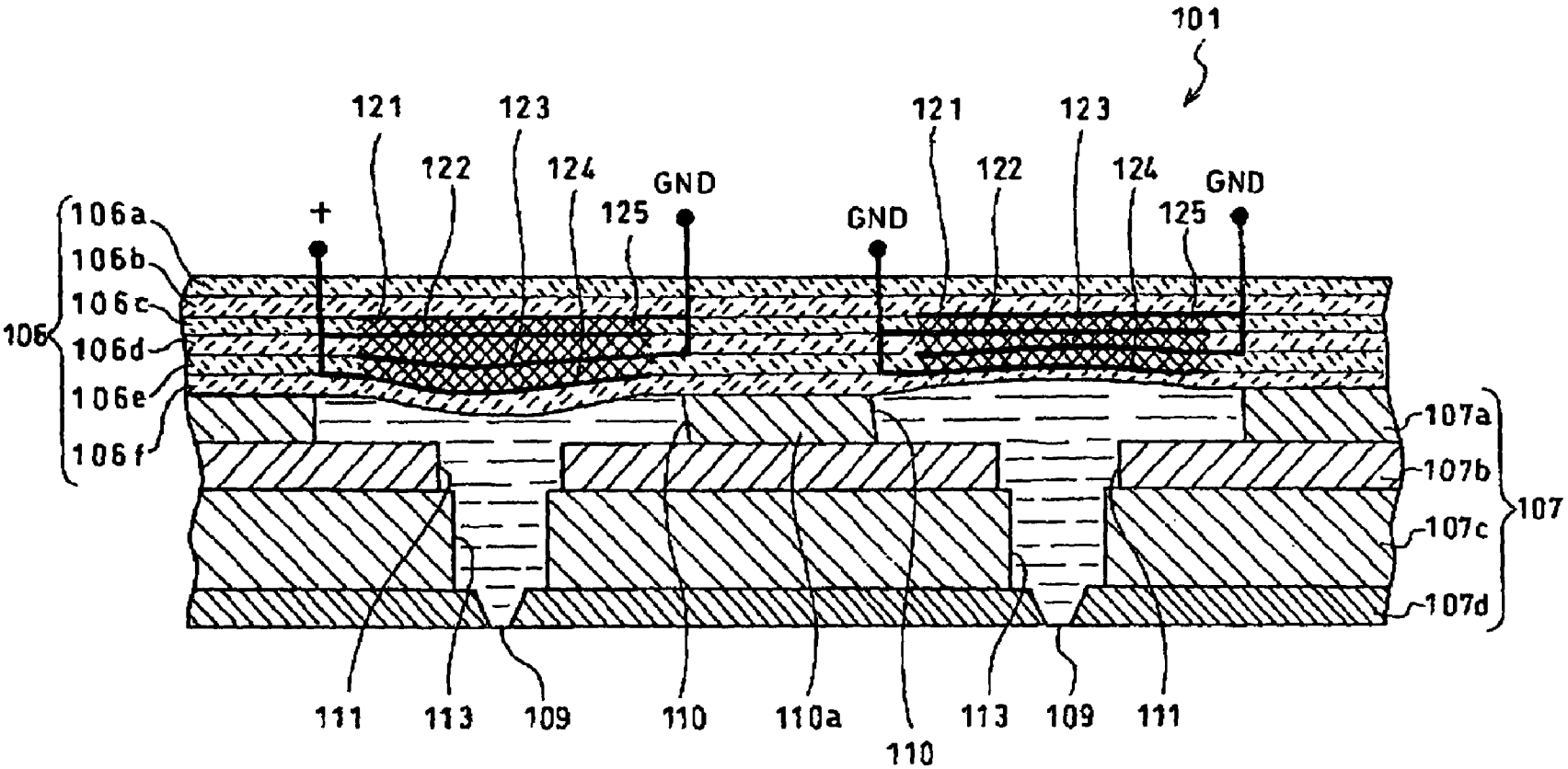
FIG. 13 is a partial sectional view of an inkjet head of a prior art taken along the length of the inkjet head.

Afterward, in Step S5, as illustrated in FIG. 11, a laser beam 59 is applied through the surface of the piezoelectric ceramic plate 6*a* in each interval between active portions 25 neighboring each other in the plane direction of the actuator unit 56. As a laser source for the laser beam 59 that can give heat to the target, for example, Yttrium Aluminum Garnet (YAG) is used. As conditions of the laser irradiation, for example, a normal pulse YAG laser of 1.06 micrometer is used, the irradiation energy is 1 to 10 J, and the pulse width is 0.2 to 2 ms. By this laser irradiation, microcrack regions 54 are formed in the piezoelectric ceramic plates 6*a* to 6*d* in each interval between neighboring active portions 25.

Afterward, an FPC 5 is bonded to the actuator unit 56. In Step S6, a high potential is applied to the individual electrodes 22 and 24 through the FPC 5 to form active portions 25 in the piezoelectric ceramic plates 6*c* to 6*e*. Through the above-described processes, such an inkjet head 51 as illustrated in FIG. 9 can be manufactured.

In a modification of the manufacturing method of this embodiment, in place of applying the laser 59 in Step S5, an indenter 60 may be used to press down the surface of the piezoelectric ceramic plate 6*a* in each interval between active portions 25 neighboring each other in the plane direction of the actuator unit 56. The indenter 60 may be provided at its tip end with an artificial diamond. As the pressing condition, for example, the load is 50 to 500 gf in a micro-Vickers indenter. Also by thus pressing with the indenter 60, microcrack regions 54 are formed in the piezoelectric ceramic plates 6*a* to 6*d* in each interval between neighboring active portions 25.

In the manufacturing method of this embodiment, the microcracks can be formed with high positional accuracy. Further, because no washing process is necessary after the microcracks are formed, an actuator unit 56 in which crosstalk is reduced can be easily fabricated in a short time in comparison with the case wherein slits are formed between active portions 25 by mechanical processing as described before.

Among microcracks formed by applying an intense electric field as in the above-described first and second embodiments, microcracks formed by irradiation with the laser 59, and microcracks formed by pressing with the indenter 60, there are differences in structure such as the lengths of cracks, the intervals between cracks, and the density of cracks. However, the present inventor has confirmed that microcracks formed through any process brings about a sufficient effect of reducing crosstalk.

Microcrack regions may be formed between neighboring active portions by a method other than those of the above-described embodiments.

Microcrack regions need not always be continuously formed to isolate neighboring active portions from each other. Microcrack regions may be discontinuously formed.

In the above-described embodiments, microcrack regions are formed in plural piezoelectric ceramic plates. However, microcrack regions may be formed in only one piezoelectric ceramic plate. Also, active portions may be formed in only one piezoelectric ceramic plate. Further, the actuator unit may include therein not plural piezoelectric ceramic plates in layers but only one piezoelectric ceramic plate.

An apparatus constructed like an inkjet printer according to any of the above-described embodiments may eject droplets of a conductive paste to print a very fine electric circuit pattern. Further, an apparatus constructed like the inkjet printer of any of the above-described embodiments may eject droplets of an organic luminescent material to make a high-resolution display device such as an organic electro luminescence display (OELD). Other than these, in applications wherein small dots are formed on a print medium, apparatus like the ink-jet printer of any of the above-described embodiments can be used very widely.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A pressure generating mechanisms comprising:

a plate member made of a piezoelectric material;

first electrodes disposed at the plate member at intervals in a plane direction of the plate member; and second electrodes opposite to the first electrodes in a thickness direction of the plate member substantially perpendicular to the plane direction of the plate member, the plate member comprising:

active portions formed in the plate member at intervals in the plane direction of the plate member, each of the active portions being sandwiched by the corresponding first and second electrodes and deformable in the thickness direction of the plate member; and a microcrack region formed in the plate member between neighboring active portions, the microcrack region including a large number of microcracks therein.

2. The pressure generating mechanism according to claim 1, wherein each of the active portions is polarized in the thickness direction of the plate member.

3. The pressure generating mechanism according to claim 2, wherein when a driving electric field is applied to an active portion sandwiched by the corresponding first and second electrodes, the active portion is deformed in the thickness direction of the plate member and the deformation of the active portion is prevented from propagating to the neighboring active portion by the microcrack region.

4. The pressure generating mechanism according to claim 1, wherein the second electrodes are connected to a common wire.

5. The pressure generating mechanism according to claim 1, wherein the microcrack region is formed through the whole thickness of the plate member.

6. The pressure generating mechanism according to claim 1, wherein the microcrack region has the same thickness as the active portions.

7. The pressure generating mechanism according to claim 1, wherein the microcrack region is formed over the whole length of the active portions to isolate the neighboring active portions from each other.

8. The pressure generating mechanism according to claim 7, wherein each active portion is sandwiched by neighboring microcrack regions.

9. The pressure generating mechanism according to claim 8, wherein the neighboring microcrack regions are formed continuously with each other to surround the corresponding active portion.

10. The pressure generating mechanism according to claim 1, wherein the mechanism further comprises a third electrode and a fourth electrode disposed between the neighboring active portions, opposite to each other in the thickness direction of the plate member, and the microcrack region is formed in a region sandwiched by the third and fourth electrodes.

11. The pressure generating mechanism according to claim 1, wherein the mechanism further comprises a third electrode disposed between the neighboring active portions, one of the first and second electrodes is elongated to a point between the neighboring active portions to be opposed to the third electrode in the thickness direction of the plate member, and the microcrack region is formed in a region sandwiched by the third electrode and the elongated electrode.

12. The pressure generating mechanism according to claim 10, wherein the plate member comprises a plurality of piezoelectric plates put in layers, the first and second electrodes are disposed alternately between the piezoelectric plates, and the third and fourth electrodes are disposed alternately between the piezoelectric plates.

13. The pressure generating mechanism according to claim 12, wherein the first and fourth electrodes are disposed on one of the piezoelectric plates, and the second and third electrodes are disposed on another one of piezoelectric plates.

14. The pressure generating mechanism according to claim 11, wherein the plate member comprises a plurality of piezoelectric plates put in layers, the first and second electrodes are disposed alternately between the piezoelectric plates, and the microcrack region is formed in a region sandwiched by the third electrode and one of the first and second electrodes elongated to the point between the active portions.

15. The pressure generating mechanism according to claim 14, wherein at least two piezoelectric plates are sandwiched by the third electrode and the elongated electrode.

16. A liquid droplet ejection device, comprising:

a pressure generating mechanism; and a wall member including partition walls defining liquid chambers, the pressure generating mechanism comprising:

a plate member made of a piezoelectric material;

first electrodes disposed at the plate member at intervals in a plane direction of the plate member; and second electrodes opposite to the first electrodes in a thickness direction of the plate member substantially perpendicular to the plane direction of the plate member, the plate member comprising:

active portions formed in the plate member at intervals in the plane direction of the plate member, each of the active portions being sandwiched by the corresponding first and second electrodes and deformable in the thickness direction of the plate member; and a microcrack region formed in the plate member between neighboring active portions, the microcrack region including a large number of microcracks therein, the plate member being fixed to the wall member so that each of the active portions corresponds to the corresponding liquid chamber and the microcrack region corresponds to the corresponding partition wall.

* * * * *